United States Patent [19]

Layden

[11] Patent Number: 5,001,399

[45] Date of Patent: Mar. 19, 1991

[54] POWER SUPPLY FOR VACUUM FLUORESCENT DISPLAYS

[75] Inventor: David L. Layden, New Lisbon, Wis.

[73] Assignee: Best Power Technology, Inc., Necedah, Wis.

[21] Appl. No.: 482,297

[22] Filed: Feb. 16, 1990

[51] Int. Cl.[5] ..... H05B 41/14; G09G 3/10

[52] U.S. Cl. ..... 315/105; 315/169.4; 315/260

[58] Field of Search ..... 315/94, 98, 105, 169.4, 315/233, 235, 260, 334, 337, DIG. 1

[56] References Cited

U.S. PATENT DOCUMENTS

| | | | |
|---|---|---|---|
| 3,553,525 | 1/1971 | McGuirk, Jr. | 315/95 |
| 4,158,794 | 6/1979 | Sandler | 315/169.1 |
| 4,209,729 | 6/1980 | McElroy | 315/169.1 |
| 4,472,660 | 9/1984 | Knothe et al. | 315/169.4 |
| 4,488,089 | 12/1984 | Shota | 315/106 |
| 4,495,445 | 1/1985 | Turney | 315/169.1 |
| 4,704,560 | 11/1987 | Mills et al. | 315/169.3 |
| 4,719,389 | 1/1988 | Miesterfeld | 315/169.1 |
| 4,791,337 | 12/1988 | Murata | 315/169.1 |
| 4,835,447 | 5/1989 | Mizuno et al. | 315/169.4 |

OTHER PUBLICATIONS

NEC Electronics, Inc.—FIP—Fluorescent Indicator Panel Application Notes, 1988, pp. 57–69, 81–85, 97–102, and cover pages.

*Primary Examiner*—David Mis
*Attorney, Agent, or Firm*—Foley & Lardner

[57] ABSTRACT

A power supply for vacuum fluorescent displays has a source of a relatively high frequency signal which is provided to a power driver amplifier which is also supplied with a desired supply voltage. The output of the driver amplifier is a square-wave signal varying between approximately zero and the supply voltage; this signal is provided to the filament of the vacuum fluorescent display such that the filament is heated and is self-biased at a DC level which is substantially one-half the supply voltage level. Self-biasing a capacitor between the filament and ground, which also allows the RMS level of the voltage across the filament to be controlled by controlling the frequency of the output signal from the driver amplifier. The voltage may be regulated by comparing the RMS voltage across the filament with a reference and using the difference to control the frequency of oscillation of the source. A voltage multiplier may be connected to receive the square-wave output from the driver amplifier to produce a higher level DC voltage which can be used to supply the grid and plate drivers with the higher voltage needed for these elements. Two driver amplifiers may be connected together with circuitry to self-oscillate, with the outputs of the two amplifiers being connected across the filament to heat the filament and self-bias the filament at one-half the DC supply voltage level.

16 Claims, 4 Drawing Sheets

SIGNAL SOURCE
40
41
Ve
43
42
13
46
48
Vs
49
52
50
51
19

POWER SUPPLY FOR VACUUM FLUORESCENT DISPLAYS

FIELD OF THE INVENTION

This invention pertains generally to the field of vacuum fluorescent display devices and particularly to the power supply and driving circuits for such devices.

BACKGROUND OF THE INVENTION

Vacuum fluorescent displays are similar to vacuum tubes. A cathode, or filament/cathode combination, and a grid and plate are mounted in an evacuated glass envelope. The plate is coated with a phosphor. During operation, the heated filament emits electrons which, if unimpeded by the grid, strike the phosphor on the plate, causing visible light photons to be emitted. Vacuum fluorescent dislays have several advantages. They are visible at almost all ambient lighting levels, and from many angles. Power consumption is relatively low and life expectancy is very high. The display can be customized, and virtually any color of display is attainable.

A primary disadvantage of the use of vacuum fluorescent display devices is that three different power supplies may be needed. For example, in the most commonly utilized filament heating system in which the filament is heated with AC power, three different power supplies are needed. The filament requires an AC voltage which is typically in the range of 3 to 6 volts, and the plates and grids require a positive 20 to 40 volts to illuminate and a negative 2 to 6 volts, relative to the filament, for the plate to be cutoff or dark. Optionally, a bias voltage can be applied to the filament in lieu of negative plate and grid bias voltages. The need for these separate power supplies has added to the size and expense of vacuum fluorescent display units and increased the complexity and cost of designing circuits which incorporate such displays. Expensive and bulky transformers are typically required, with associated oscillators and drivers. The driving circuit typically takes up significant space, tends to be inefficient, and may lead to electromagnetic interference (EMI) and in some cases acoustic noise. Such drive circuits also tend to consume relatively large amounts of power, limiting the suitability of vacuum fluorescent displays for portable devices and other applications in which power consumption is critical.

SUMMARY OF THE INVENTION

In accordance with the present invention, a power supply for vacuum fluorescent display devices receives a DC supply voltage and provides an alternating current voltage to the filament to heat the filament as well as a higher DC supply voltage to the grid and plate segment drivers. The power supply is implemented with low cost components, has few parts, and eliminates the need for magnetics of any sort to generate the requisite voltages. The circuit has low bulk and can be incorporated as a single power supply device, suitable for integration, taking relatively little space and consuming very little power.

The power supply for the vacuum fluorescent filament in accordance with the invention includes a source of a relatively high frequency (e.g., 50 KHz) signal, such as an integrated circuit timer, a microprocessor, or a simple resistor-capacitor oscillator. The output of the oscillator is provided to a driver amplifier which is supplied with a desired source voltage. The driver amplifier is capable of putting out a high power output signal at the same frequency as the input signal. The power amplifier output is provided across the vacuum fluorescent filament, without a separate DC biasing voltage being required, to provide the filament with the desired high frequency AC heating current. In one embodiment, the filament may be self-biased to a voltage at substantially one-half the supply voltage to the power amplifier by connecting the filament to ground through a capacitor. In this configuration, the resistance of the filament and the reactance of the capacitor form a voltage divider which controls the RMS valve of the voltage across the filament in accordance with the frequency of the signal applied to the filament. The filament voltage may be controlled in a feedback manner by providing the RMS voltage across the filament to a differential amplifier which drives a voltage controlled oscillator which supplies its output signal to the power amplifier. In another embodiment, two power amplifiers are connected to either side of the filament and are cross-coupled to each other with resistive and capacitive coupling so that the stages self-oscillate. The filament is effectively connected in a bridge configuration and self-biases at one-half the level of the supply voltage supplied to the power amplifiers.

The output of the power amplifier or amplifiers is also preferably provided to a voltage multiplier supplied with a selected DC source voltage. The alternating pulse outputs of the amplifier or amplifiers driving the filament also drive the voltage multiplier to produce the desired high voltage plate and grid supply voltage, e.g. 20 to 40 volts DC. The voltage multipliers are preferably charge-pump converters having two or more stages. No magnetics are required to generate these high voltages.

It is a particular advantage of the filament supply voltage provided in accordance with the present invention that the average filament voltage is equipotential along the length of the filament, resulting in display brightness which is the same at each of the plate segments, and thereby eliminating the need for specially designed circuitry typically encountered in vacuum fluorescent displays to even out the brightness of the segments.

Further objects, features, and advantages of the present invention will be apparent from the following detailed description when taken in conjunction with the accompanying drawings.

DETAILED DESCRIPTION OF THE INVENTION

Figure 1:
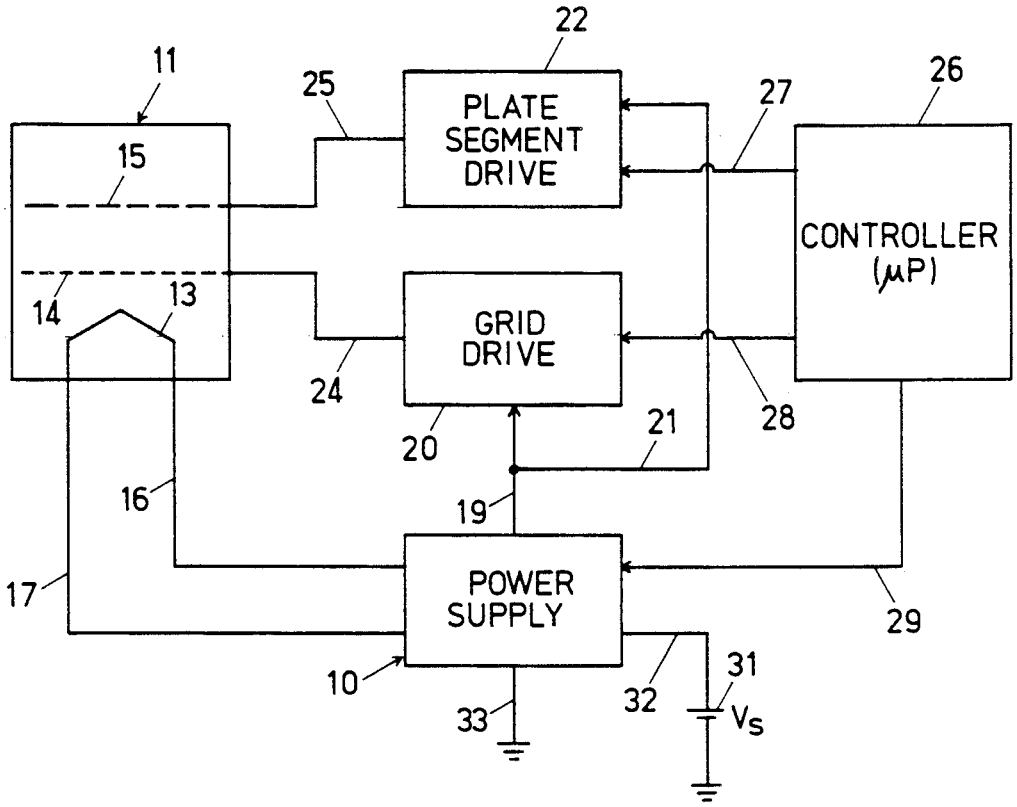
FIG. 1 is a schematic block diagram of a vacuum fluorescent display system incorporating the power supply of the present invention.

With reference to the drawings, a block diagram of a vacuum fluorescent display system is shown in FIG. 1 which incorporates the power supply 10 of the present invention in conjunction with a vacuum fluorescent display device shown schematically at 11. The display device 11 has a filament/cathode 13, a control grid 14, and plate segments 15. The power supply 10 provides output power on lines 16 and 17 to the filament 13 at a selected alternating current level and a high DC voltage on a line 19 to a grid driver circuit 20 and, through a line 21, to a plate segment driver circuit 22. The grid driver circuit 20 provides voltage control signals on lines 24 to the grid segments 14, while the plate segment driver 22 provides voltage signals on lines 25 to the plate segments 15. For clarity of illustration, only a single line 24 and a single line 25 are shown in FIG. 1, although it is understood that separate lines would be provided to each of the segments of the plate 15 and each of the sections of the grid 14.

The information displayed on the device 11 is provided from a control device 26, which may be a microprocessor, or another system which determines the information to be displayed. The controller 26 provides output signals on line(s) 27 to the plate segment drive circuit 22 and on line(s) 28 to the grid driver circuit 20. As explained further below, the microprocessor may also provide a signal at a selected pulse frequency on a line 29 to the power supply 10. It is understood that the control 26 may be any of the various possible devices that provide control signals to determine the information to be displayed, and that the plate segment driver 22 and the grid driver 20 are standard circuits well known in the art.

The power supply circuit 10 receives its power from a power source 31 providing a DC voltage level $V_s$ on a line 32. Power supply 10 is also connected to ground through a line 33.

Figure 2:
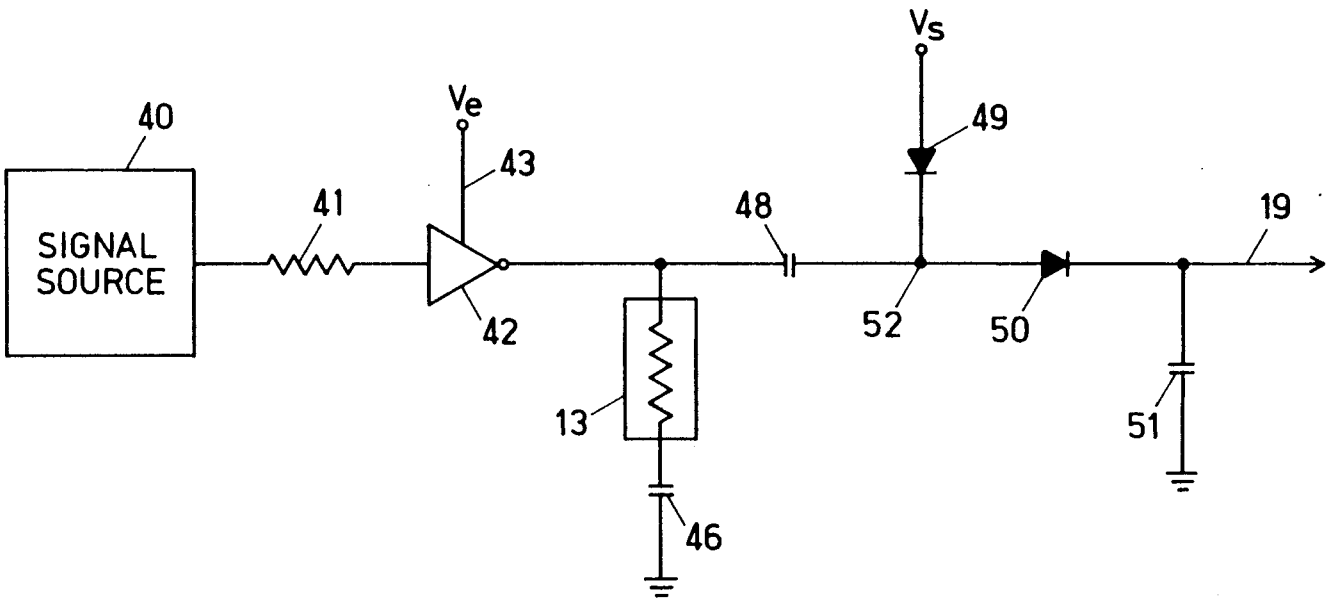
FIG. 2 is a schematic circuit diagram of a vacuum fluorescent power supply in accordance with the present invention.

A schematic circuit diagram for one embodiment of a circuit comprising the power supply 10 of the present invention is shown in FIG. 2. A high frequency signal is provided from a source 40, which may be the microprocessor 26 providing the output signal on a line 29. The high frequency signal from the source, e.g., an oscillator 40, is preferably at a frequency above the audible range, e.g., 50 KHz. This signal is provided through an input resistor 41 to a power driver amplifier 42 which receives a supply level voltage $V_e$ (e.g., 9 volts) which may be the same as the supply voltage $V_s$, or a lower voltage level provided from a voltage regulator (not shown). One example of a suitable power amplifier is a Teledyne Semiconductor Model #TSC4426 single stage driver.

The output voltage from the amplifier 42 is a square-wave type signal, at the frequency of the source 40, which varies between zero volts and $V_e$. This voltage is applied to one side of the filament 13 of the vacuum fluorescent display device, the other side of which is connected through a capacitor 46 to ground. A suitable value for the capacitor 46, with a vacuum fluorescent filament having a typical hot resistance of 150 ohms, is 0.012 microfarads. The serially connected filament 13 and capacitor 46 act as a voltage divider, such that the RMS (root means square) value of the voltage across the filament can be controlled by controlling the frequency of the signal from the oscillator 40. Within certain limits and constraints, the voltage across the filament 13 may be approximated by the formula:

$$\frac{V_e R}{R + 1/(2\pi fC)},$$

where $V_e$ is the voltage of the power supplied to the amplifier 42, R is the resistance of the filament while hot, f is the frequency of the output from the amplifier 42 and C is the capacitance of the capacitor 46.

Utilizing the circuit shown in FIG. 2, the filament automatically self-biases to one-half the supply voltage $V_e$ (e g., to a level of 4.5 volts for a 9 volt supply voltage), thereby providing the necessary positive bias voltage to cut off the plate segments.

The output voltage from the driver amplifier 42 is also provided to a charge-pump converter, acting as a voltage multiplier, which is composed of a capacitor 48, a diode 49, a diode 50, and an output capacitor 51. The diode 49 is connected between a desired supply voltage $V_s$ (e.g., 12 volts), which may be the same as the voltage $V_e$, and a node 52 to which the capacitor 48 and the diode 50 are connected. When the output of the amplifier 42 drops to zero volts, the voltage across the capacitor 48 will go to $V_s$ (e.g., 12 volts). When the output voltage from the amplifier 42 goes high, this voltage is applied to the plate 48 which causes the node 52 to go to a voltage equal to approximately $V_e+V_s$, forwardly biasing the diode 50 and charging the capacitor 51 to a DC level maintained at or near $V_e+V_s$. This DC voltage is provided to the plate and grid drivers 20 and 22 on the line 19.

Figure 3:
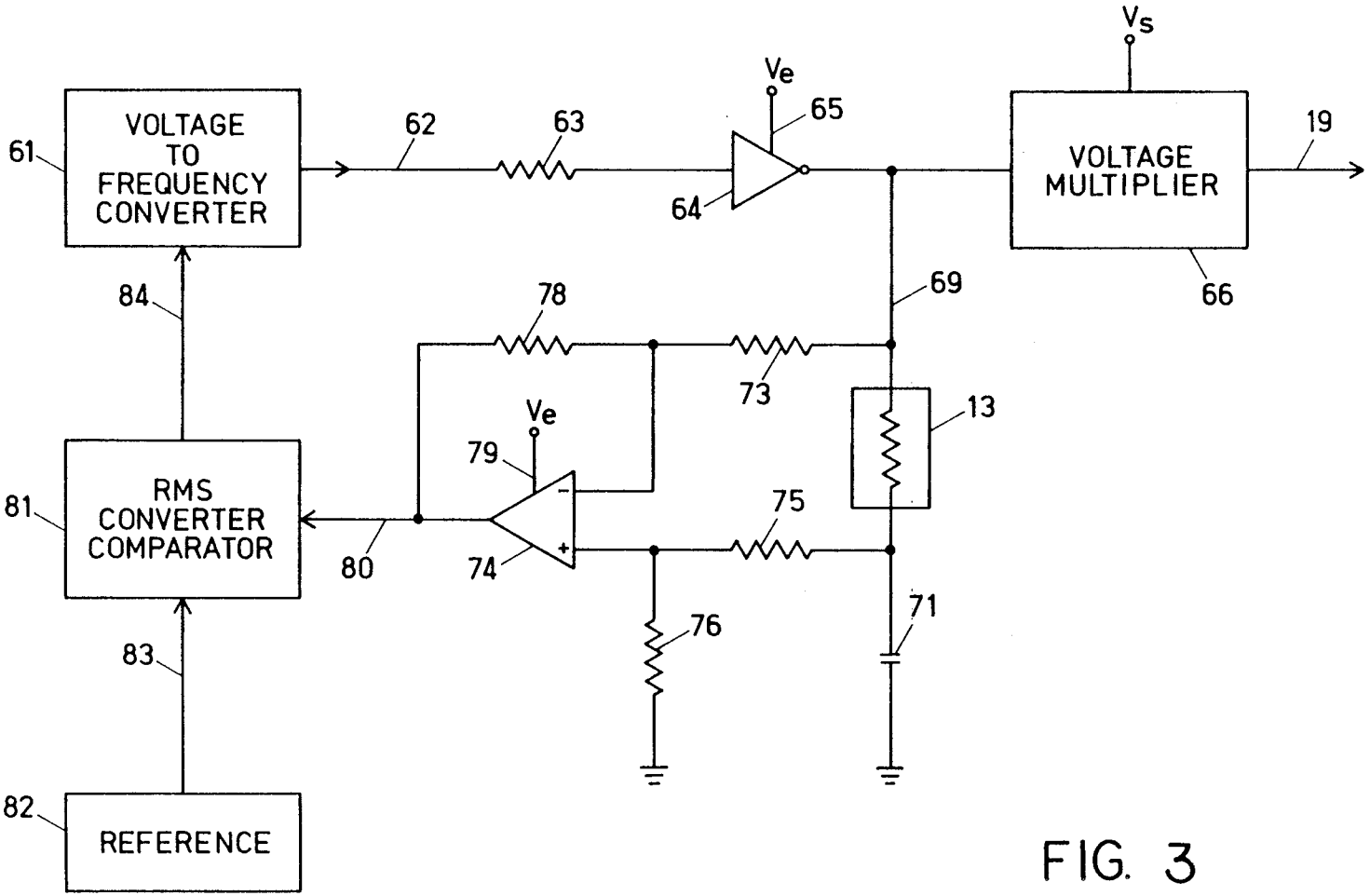
FIG. 3 is a schematic circuit diagram of a vacuum fluorescent power supply similar to that of FIG. 2 but utilizing feedback control of the filament voltage.

FIG. 3 shows a modification of the circuit of FIG. 2 which may be utilized if the supply voltage $V_e$ is variable rather than being a regulated supply voltage. In the circuit of FIG. 2, if the supply voltage $V_e$ varies, the filament voltage will vary in direct proportion to it. The circuit of FIG. 3 provides a regulated voltage across the filament despite variations in the value of $V_e$.

In this circuit, a voltage to frequency converter 61 provides a time varying signal on an output line 62 through an input resistor 63 to a driver amplifier 64 (e.g., Teledyne Semiconductor #TSC4426) which receives the supply voltage $V_e$ on a supply line 65. The output of the driver amplifier 64 is provided through a supply line 69 to the filament 13 and through a capacitor 71 to ground. The voltage on the line 69 divides across the filament 13 and the capacitor 71 in the same manner as described above for the filament 13 and the capacitor 46 in the circuit of FIG. 2.

The voltage across the filament 13 is provided through a series resistor 73 to one input of a differential operational amplifier 74 and at the other side of the filament through a voltage divider formed of a resistor 75 and a resistor 76 to the other (non-inverting) input of the amplifier 74. The amplifier 74 receives the supply voltage $V_e$ on a supply line 79 and has its output fed back through a resistor 78 to the inverting input. The output of the amplifier 74 on a line 80 is provided to an RMS converter/comparator 81 which also receives, from a voltage reference source 82, a reference voltage on a line 83. The comparator 81 compares the voltages on the lines 80 and 83 and puts out an output voltage on a line 84 which is proportional to the difference between the two voltages. The comparator 81 is a root-mean-square (RMS) voltage converter/comparator of standard design. The error signal on the line 84 is used to compensate the voltage to frequency converter 61 such that if the RMS voltage of the filament should drop below the reference voltage supplied by the reference circuit 82, the frequency of oscillation from the converter 61 would increase, causing a higher RMS voltage value to be applied to the filament. If the voltage across the filament rises above the reference voltage, the circuit would slow the frequency provided from the voltage to frequency converter 61, until equilibrium was once again reached. Thus, the RMS voltage across the filament will always be substantially constant regardless of changes in the supply voltage.

Figure 4:
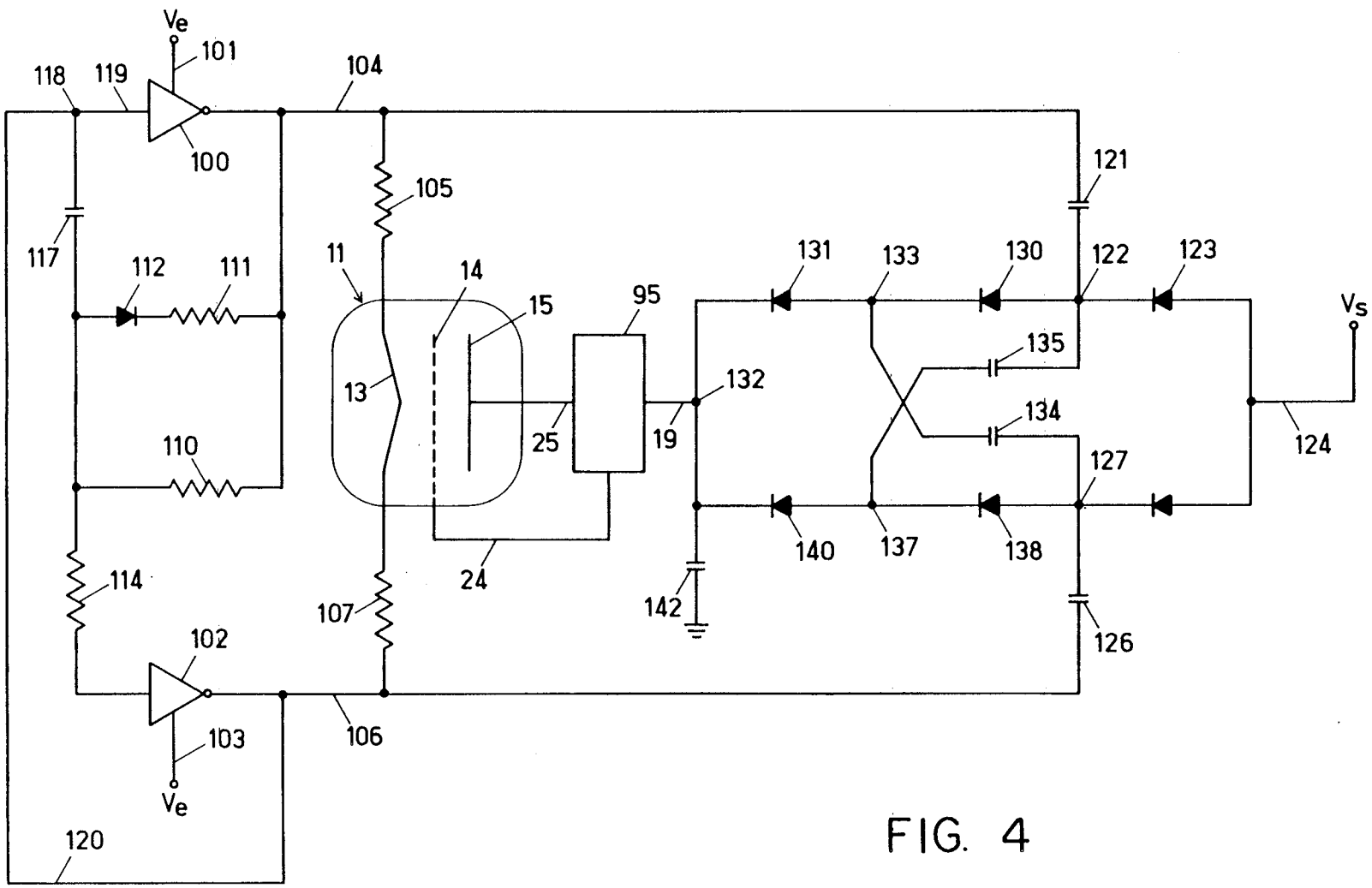
FIG. 4 is an alternative embodiment of a vacuum fluorescent power supply in accordance with the present invention.

A modified embodiment of a power supply ciruit in accordance with the present invention is shown in FIG. 4 in conjunction with a vacuum fluorescent display device illustrated generally at 11. The device 11 has a filament/cathode 13, a grid represented schematically at 14, and a plate represented schematically at 15. The controller, which provides the information which is to be displayed, and the grid driver and the plate driver are represented schematically by the box 95, which is illustrated as providing plate drive signals on a line 25 to the plate 15 and grid drive voltages on a line 24 to the grid 14.

The filament drive circuit includes two driver amplifiers, a first amplifier 100, receiving a supply voltage $V_e$ on a line 101, and a second amplifier 102, receiving the supply voltage $V_e$ on a line 103. A suitable pair of driver amplifier stages is provided by a Teledyne Semiconductor #TSC4428. The amplifier 100 is an inverting amplifier and the amplifier 102 is a non-inverting amplifier. The output of the amplifier 100 is provided on a line 109 through a series connected resistor 111 and diode 112, and through a resistor 110 which is connected in parallel with the resistor 111 and the diode 112. These parts are connected in series with a resistor 114 to the input line 115 of the non-inverting amplifier 102. The signal from the output of the amplifier 100 is also passed on a feedback path through the resistor 110 and the resistor 111 and diode 112 through a capacitor 117 to a node 118 which is connected to the input line 119 of the amplifier 100. The output from the amplifier 102 is also connected via a line 120 to the node 118. So connected, the stages formed by the two amplifiers 100 and 102 self-oscillate at a frequency controlled by the value of the resistors 111 and 110 and the capacitor 117. The diode 112 and the resistor 111 are preferably provided as shown, connected in parallel with the resistor 110, to provide a symmetrical duty-cycle. If the drive stage has symmetrical inputs, it does not require a duty-cycle adjustment as provided by the resistor 111 and the diode 112.

The output of the amplifier 100 is connected on a line 104 through a resistor 105 to one side of the filament 13, whereas the output voltage from the amplifier 102 is connected on a line 106 through a resistor 107 to the other side of the filament. The filament is driven in a bridge configuration with the current limiting resistors 105 and 107 dropping the voltage across the filament to that which is optimal for the filament. The filament self-biases at a voltage equal to one-half the supply voltage $V_e$.

The oscillating squarewave voltages on the lines 104 and 106 may again be utilized to provide the high voltages required by the grid and plate drivers. This may be accomplished by the charge-pump converter circuit illustrated in FIG. 4. In this circuit, the voltage on the line 104 is provided through a capacitor 121 to an input node 122. A supply voltage $V_s$ on a line 124 is connected through a diode 123 to the node 122. The voltage from the amplifier 102 on the line 106 is provided through a capacitor 126 to an input node 127. A diode 128 is connected between the node 127 and the supply voltage line 124. Diodes 130 and 131 are connected between the node 122 and an output node 132 which is connected to the line 19 to provide the high DC voltage to the grid and plate drivers in the circuit 95. A capacitor 134 is connected between the node 127 and the node 133 which joins the diodes 130 and 131. A capacitor 135 is connected between the node 122 and a node 137 which connects diodes 138 and 140; these diodes are connected to conduct between the node 127 and the node 132. An output capacitor 142 is connected between the node 132 and ground or common. The charge-pump circuit of FIG. 4 functions in a manner analogous to that of the circuit of FIG. 2, except that a pulse charging the output capacitor 142 is provided on every half cycle rather than once a cycle as in the circuit of FIG. 2, since the amplifiers 100 and 102 alternate in providing a charging pulse to the charge-pumping converter circuit.

Athough a simple two phase charge-pump converter circuit has been shown as the voltage multiplier in the exemplary circuits above, it is understood that three or more phase charge pump converters and other comparable voltage multipliers may also be utilized.

Utilizing the vacuum fluorescent power supply of the present invention, the total parts cost for the power supply is typically one-quarter of that required utilizing a magnetic design having bulky and expensive transformers. The power supply circuit is simpler, more reliable, and radiates no EMI. The physical volume of the circuit as implemented on a printed circuit board is about one-tenth to one-thirtieth the volume needed by transformer supplies. The volume required is sufficiently small that it could be incorporated within the vacuum fluorescent display envelope, if desired.

It is understood that the invention is not limited to the particular embodiments described herein, but embraces such modified forms thereof as come within the scope of the following claims.

What is claimed is:

1. A power supply for a vacuum fluorescent displays of the type having a filament, a grid and plate electrodes, comprising:

(a) source means for providing an alternating voltage signal at a selected frequency;

(b) a power driver amplifier supplied with a supply voltage and receiving at its input the signal from the source means and providing a pulse output signal which varies over substantially the supply voltage; and (c) means for applying the output of the driver amplifier to the filament of the vacuum fluorescent display device such that the filament self-biases to a DC level about one-half the supply voltage level provided to the driver amplifier.

2. The power supply of claim 1 wherein the means for applying the output of the driver amplifier to the filament includes a capacitor connected between the filament and ground such that the output from the amplifier passes through the filament and the capacitor to provide an alternating voltage across the filament at an RMS level which is related to the frequency of the signal from the source and so that the DC bias level is maintained in the filament.

3. The power supply of claim 2 further including means for comparing the RMS level of the voltage across the filament to a reference and providing an output signal which is proportional to the difference, and wherein the source means is a voltage to frequency converter responsive to an input signal, and wherein the difference output signal is provided to the voltage to frequency converter to control the frequency of the output from the converter such that the frequency increases as the RMS voltage across the filament decreases and the frequency decreases as the RMS voltage across the filament increases, whereby the RMS voltage across the filament is maintained at a desired level.

4. The power supply of claim 1 further including voltage multiplier means, receiving a supply voltage and the pulsed output signal from the driver amplifier, for providing a DC output voltage which is higher than the supply voltage received by it.

5. The power supply of claim 4 wherein the voltage multiplier means includes a capacitor connected between the output of the driver amplifier and a node, a diode connected between the supply voltage and the node to conduct toward the node, and an output diode connected on an output line from the node to conduct fowardly and an output capacitor connected between the output of this diode and ground to receive pulses of high voltage for charging the output capacitor to the higher DC level.

6. The power supply of claim 1 wherein there is a second driver amplifier receiving the supply voltage, one of the amplifiers being an inverting amplifier and the other a non-inverting amplifier and wherein the source means includes circuitry means for cross-coupling the output of each of the amplifiers to the input of the other amplifier such that the amplifiers self-oscillate at a desired frequency, the output voltages from the amplifiers being connected to opposite sides of the filament such that the filament self-biases to a DC level at about one-half the supply voltage.

7. The power supply of claim 6 wherein the cross-coupling circuitry means includes a feedback circuit around the inverting amplifier comprised of a feedback resistor and feedback capacitor in series connected between the input and output of the amplifier to cause oscillations to occur at a frequency determined by the resistive-capacitive time constant of the feedback circuitry.

8. The power supply of claim 6 further including voltage multiplier means connected to the outputs of the two amplifiers and receiving a supply voltage and for providing output voltage at a DC level which is substantially higher than the supply voltage.

9. The power supply of claim 8 wherein the voltage multiplier means includes, for each of the two amplifiers, a capacitor connected between the output of each amplifier and an input node, diodes connected between the supply voltage and for each amplifier, input nodes to conduct the supply voltage toward the nodes, diodes connected between the input nodes and an output node to conduct current forwardly and an output capacitor connected between the output mode and ground such that a pulse output is provided to charge the output capacitor on each pulse from the driver amplifiers.

10. A method of controlling the voltage across the filament of a vacuum fluorescent display which includes a filament, a grid and plate electrodes, comprising the steps of:

(a) providing a pulse drive signal which varies in a square-wave between a high voltage level and a lower or ground voltage level;

(b) applying the pulse driver signal across the filament and a capacitor connected in series to ground such that the RMS value of the voltage provided thereto divides between the filament and the capacitor;

(c) adjusting the frequency of the pulse drive signal from the amplifier to reach a desired RMS voltage level across the filament.

11. The method of claim 10 further including the step of comparing the RMS voltage across the filament with a reference voltage to determine the difference and adjusting the frequency of the pulsed drive signal to the filament in proportion to the difference.

12. A power supply for a vacuum fluorescent display of the type having a filament, a grid and plate electrodes, comprising:

(a) a first inverting power driver amplifier receiving a supply voltage and a second non-inverting power driver amplifier receiving the supply voltage;

(b) circuit means for coupling the output of each amplifier to the input of the other amplifier such that the amplifiers self-oscillate at a selected frequency with their output voltages providing a substantial square-wave signal differing in voltage between a lower or ground level and the supply voltage level; and (c) means for connecting the outputs of the driver amplifiers to opposite sides of the filament to heat the filament such that the filament self-biases at approximately one-half of the supply voltage provided to the driver amplifiers.

13. The power supply of claim 12 wherein the circuit means includes a resistor and capacitor connected in a feedback loop between the input and the output of the inverting amplifier to control the frequency of osciallation in accordance with the resistive-capacitive time constant of the resistor and capacitor.

14. The power supply of claim 12 wherein the means for connecting the outputs of the amplifiers to the opposite sides of the filament include a current-limiting resistor connected between the output of each amplifier and the filament.

15. The power supply of claim 12 further including voltage multiplier means connected to the outputs of the two amplifiers and receiving a supply voltage and for providing output voltage at a DC level which is substantially higher than the supply voltage level.

16. The power supply of claim 15 wherein the voltage multiplier means includes, for each of the two amplifiers, a capacitor connected between the output of each amplifier and an input node for each amplifier, diodes connected between the supply voltage and the input nodes to conduct the supply voltage toward the modes, and diodes connected from the input nodes to an output node, and to conduct forwardly an output capacitor connected between the output mode and ground, such that a pulse output is provided to charge the output capacitor on each pulse from the driver amplifiers.

* * * * *